US008232938B2

(12) United States Patent
Kohno

(10) Patent No.: US 8,232,938 B2
(45) Date of Patent: Jul. 31, 2012

(54) DRIVING DEVICE AND DRIVING METHOD FOR DISPLAY DEVICE

(75) Inventor: Makoto Kohno, Kanagawa (JP)

(73) Assignee: Global OLED Technology LLC, Herndon, VA (US)

( * ) Notice: Subject to any disclaimer, the term of this patent is extended or adjusted under 35 U.S.C. 154(b) by 990 days.

(21) Appl. No.: 12/281,487

(22) PCT Filed: Mar. 1, 2007

(86) PCT No.: PCT/US2007/005421

§ 371 (c)(1),
(2), (4) Date: Sep. 3, 2008

(87) PCT Pub. No.: WO2007/106335

PCT Pub. Date: Sep. 20, 2007

(65) Prior Publication Data

US 2009/0174634 A1 Jul. 9, 2009

(30) Foreign Application Priority Data

Mar. 14, 2006 (JP) ..... 2006-069933

(51) Int. Cl.
*G09G 3/30* (2006.01)

(52) U.S. Cl. ..... 345/77; 345/36; 345/45; 345/84; 714/726

(58) Field of Classification Search ..... 345/36–45, 345/76–77, 84; 714/726
See application file for complete search history.

(56) References Cited

U.S. PATENT DOCUMENTS

| | | | | |
|---|---|---|---|---|
| 6,091,389 | A * | 7/2000 | Maeda et al. | 345/98 |
| 6,806,852 | B2 | 10/2004 | Ishizuka et al. | |
| 7,817,171 | B2 * | 10/2010 | Shiomi | 345/690 |
| 2005/0057581 | A1 | 3/2005 | Horiuchi et al. | |
| 2008/0211801 | A1 * | 9/2008 | Shiomi | 345/214 |

FOREIGN PATENT DOCUMENTS

| | | | | |
|---|---|---|---|---|
| EP | 1286542 | | 2/2003 | |
| EP | 1310935 | | 5/2003 | |
| JP | 07-322179 | | 12/1995 | |
| JP | 2000-250463 | | 9/2000 | |
| WO | WO2006025359 | * | 3/2006 | 345/690 |

* cited by examiner

*Primary Examiner* — Kevin M Nguyen
*Assistant Examiner* — Cory Almeida
(74) *Attorney, Agent, or Firm* — Morgan, Lewis & Bockius LLP

(57) ABSTRACT

A driving method of a display device in which an image is displayed on a display panel having a display element arranged in a pixel matrix, includes comparing, among pixel data corresponding to a display content in each pixel, pixel data corresponding to an nth horizontal scan line of an Nth frame and pixel data corresponding to an nth horizontal scan line of an (N−1)th frame; and setting a brightness reduction ratio with respect to pixel data corresponding to the nth horizontal scan line of the Nth frame or a later horizontal scan line of the Nth frame based as a function of the comparison and all pixel data corresponding to the (N−1)th frame or all pixel data from the nth horizontal scan line of the (N−1)th frame to an (n−1)th horizontal scan line of the Nth frame and controlling power supplied.

10 Claims, 11 Drawing Sheets

COMPARATIVE EXAMPLE

DRIVING DEVICE AND DRIVING METHOD FOR DISPLAY DEVICE

FIELD OF THE INVENTION

The present invention relates to a method for limiting maximum power consumption in a display device in which display elements are arranged in a matrix form.

BACKGROUND OF THE INVENTION

Conventionally, a liquid crystal display device (LCD) or the like is known as a flat display device having a thin thickness, a small size, and a low power consumption. Recently, display devices have been developed which use a light emitting element (electroluminescence element) in each pixel. In particular, organic light emitting display devices (hereinafter referred to as "OLED display devices") which use an organic light emitting element (hereinafter referred to as "OLED element") in which an organic material is used in a light emitting material or the like are being developed and researched.

The OLED element is a current-driven, self-emissive element which emits light at a luminance corresponding to a current flowing through the element. Therefore, the OLED elements have advantages that the viewing angle dependency which is observed in an LCD is low, that the visibility is high because no light source is required, that a display device with a low power consumption can be achieved with a smaller space, etc., and expectations are rising.

In the display devices which use the OLED element, a current which is approximately proportional to the average luminance of a displayed image flows in the display panel as a whole. Thus, when a darker image is to be displayed, the power consumption is very low, but the power consumption of the panel is increased as the image becomes brighter. When light emission of luminance near the maximum luminance continues in all pixels, the advantage of the low power consumption with the OLED panel is reduced.

Moreover, currently, the OLED elements are known to have problems regarding lifetime. The lifetime and the power consumption of the element depend on a product of the light emission luminance and the light emission period. In consideration of this, U.S. Pat. No. 6,806,852 (hereinafter referred to as "'852 reference") discloses limitation of the light emission luminance in order to extend the lifetime of the element and reduce the power consumption. The '852 reference discloses that pixel data is stored in units of frames, average brightness or the like is calculated for the data, and a brightness reduction process is applied to image frame data according to the calculation result.

Japanese Patent Laid-Open Publication No. Hei 7-322179 (hereinafter referred to as "'179 reference") discloses that pixel data is stored in units of frames, a histogram is calculated, a correction value of γ correction with respect to pixel data is adjusted based on the result of the calculation, and the brightness is adjusted for the pixel data in order to inhibit black and white saturations and improve contrast in LCDs and in PDPs.

With the brightness reduction process as described in the '852 reference, driving data can be created to not exceed a limitation current of a panel, the current flowing through each OLED element can be reduced, and the power consumption can be reduced. However, in the process of the '852 reference, a frame memory must be provided and accurate control cannot be applied unless the displayed frame and the frame used for calculation are identical. From a technical point of view, the frame memory may be omitted in order to reduce the size of the circuit or reduce the cost. However, when the frame memory is omitted, the response is delayed by one frame. In other words, rapid change in brightness cannot be handled and the current exceeds the limit current for at least one frame period. In this structure, sufficient reduction of power consumption and sufficient elongation of the lifetime of the OLED element cannot be achieved. In addition, when the current exceeds the limit current, the display luminance may rise rapidly and the raised luminance continues for approximately one frame period, and thus, a viewer may notice the high brightness, resulting in degradation of the display quality.

In a brightness adjusting method of the '179 reference also, a frame memory is required. When no frame memory is provided, accurate control cannot be applied. If a frame memory is omitted, when a brightness level of pixel data rises rapidly, such a case cannot be handled and the inhibition advantage of the power consumption is reduced. Moreover, because a correction value which is set to achieve a superior contrast near the black level until immediately before the rise of the brightness level, for example, is applied, gradation at the white level side is lost and there is a problem in that an image of white saturation tends to be displayed, resulting in a problem of degradation of display quality.

SUMMARY OF THE INVENTION

In the present invention, power consumption of a display device is instantaneously and reliably inhibited with a simple structure even when a level of input pixel data (brightness level) is high.

According to one aspect of the present invention, there is provided a driving device, for a display device, for realizing display of a desired image on a display panel having a display element in each of a plurality of pixels arranged in a matrix form by controlling power to be supplied to each display element, the driving device comprising a comparative calculation unit that compares, among pixel data corresponding to a display content in each pixel, pixel data corresponding to an nth horizontal scan line in an Nth frame and pixel data corresponding to an nth horizontal scan line of an (N−1)th frame, and a brightness determination unit that sets a brightness reduction ratio, wherein the brightness determination unit determines the brightness reduction ratio with respect to pixel data corresponding to the nth horizontal scan line of the Nth frame or a later horizontal scan line of the Nth frame according to a result of the comparative calculation and a total value of all pixel data corresponding to the (N−1)th frame or a total value of all pixel data from the nth horizontal scan line of the (N−1)th frame to an (n−1)th horizontal scan line of the Nth frame.

According to another aspect of the present invention, it is preferable that the driving device further comprises a line data calculation unit that sequentially calculates a sum or an average of pixel data for each horizontal scan line.

According to another aspect of the present invention, it is preferable that, in the driving device, the brightness determination unit determines a predicted value of all pixel data of the Nth frame based on the result of the comparative calculation and the total value of all pixel data corresponding to the (N−1)th frame or the total value of all pixel data from the nth horizontal scan line of the (N−1)th frame to the (n−1)th horizontal scan line of the Nth frame supplied from the line data calculation unit, and when the total predicted value exceeds a predetermined limit value, the brightness determination unit determines the brightness reduction ratio with respect to the pixel data corresponding to the nth horizontal scan line or the later horizontal scan line of the Nth frame in such a manner that the predicted value does not exceed the predetermined limit value.

According to the present invention, pixel data corresponding to one horizontal scan line (sum or average) is calculated and is compared with pixel data of the same line, but of the previous frame. In other words, a change in brightness in successive frames is predicted by a calculation using pixel data of one line. Because of this structure, no frame memory is required for brightness adjustment and the power consumption of the display device can be reduced by limiting the panel current with a very simple structure.

In addition, in the present invention, the brightness reduction ratio can be determined based on the result of the comparison and pixel data of one frame obtained by adding pixel data for each line at the frame data calculating unit. The pixel data of one frame is data of a past frame and is obtained by accumulating and adding pixel data corresponding to one horizontal scan line used in the comparative calculation unit. Therefore, pixel data of one frame can be obtained without the use of a frame memory or the like.

When pixel data of the nth horizontal scan line of the Nth frame which is to be currently displayed is increased with respect to the pixel data of the nth horizontal scan line of a previous frame, the current value for the entire panel of the Nth frame is predicted assuming that the data (brightness) value will increase at the same rate. When the predicted value exceeds a limit value, the brightness reduction ratio is applied so that the predicted value does not exceed the limit value. Therefore, when, for example, an OLED panel or the like, in which a current corresponding to the brightness level indicated by the pixel data flows and the power consumption of the panel is determined based on the current, is to be driven, the brightness reduction ratio can be determined quickly and with a very simple structure and a brightness limitation process can be applied in real time.

Factors that cause rapid increase in the brightness of input pixel data in displays of digital still cameras (DSC) and digital video cameras (DVC) include, for example, rapid increase in illumination irradiated on an imaging target or rapid increase of the brightness due to a brightness adjustment of a driver circuit. In this case, entire image is brightened without the scene itself changing. In this situation also, according to the driving method and driving method of the present invention, the brightness can be quickly and reliably limited and low power consumption can be achieved. In addition, loss of gradation can also be prevented when the brightness is increased rapidly, and high quality display can be realized at all times.

BRIEF DESCRIPTION OF THE DRAWINGS

Preferred embodiments of the present invention will be described in detail by reference to the drawings, wherein.

DESCRIPTION OF THE PREFERRED EMBODIMENTS

First Preferred Embodiment

Figure 1:
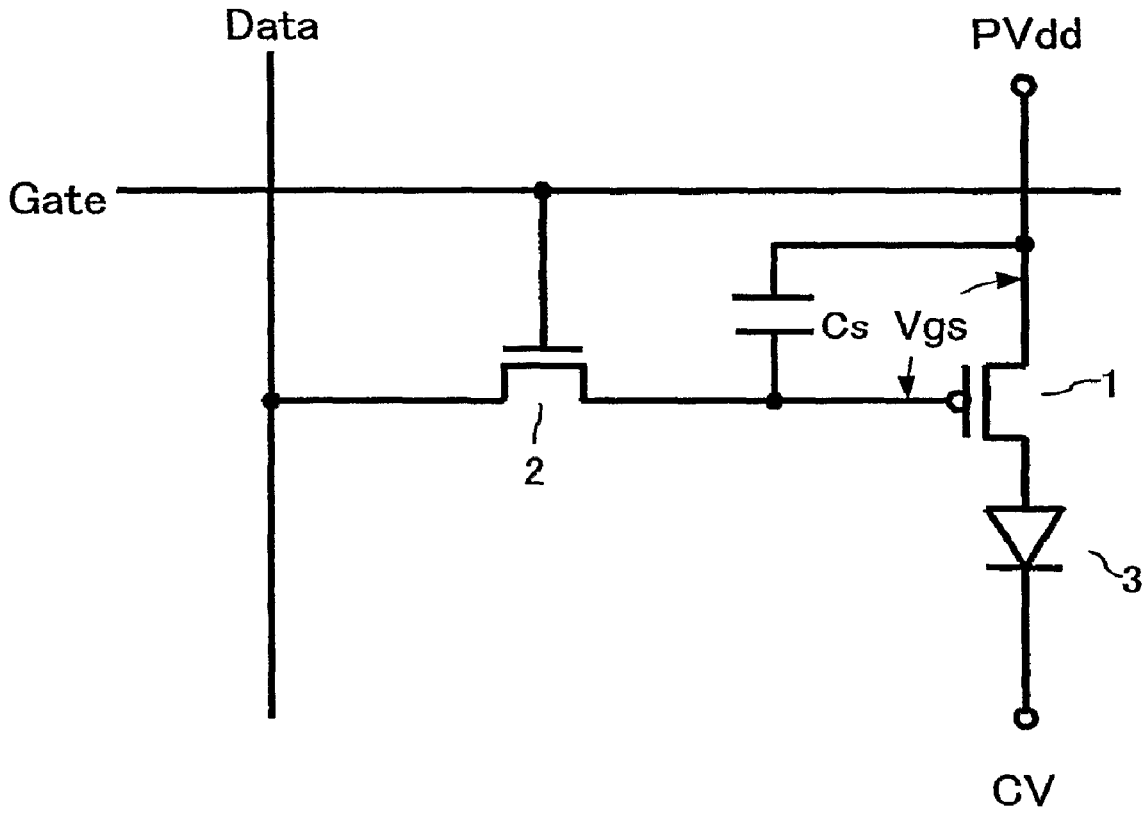
FIG. 1 is a diagram showing a circuit structure of one pixel of an active type OLED panel to which the preferred embodiments of the present invention can be applied.

A first preferred embodiment of the present invention will now be described. A driving device and a driving method of the first preferred embodiment is employed in driving a display device comprising a display panel having a display element in each of a plurality of pixels arranged in a matrix of k (rows; horizontal scan direction) by l (columns; vertical scan direction), in which a desired image is displayed by controlling brightness of each pixel. As the display panel, it is possible to use a panel having a current-driven display element in each pixel, for example, an OLED (organic light emitting diode) panel which uses an OLED element which is a light emitting element having a diode structure as the display element.

As described, in an OLED element, the light emission brightness is approximately proportional to an amount of supplied current and the amount of current flowing through each of the OLED elements is increased as the displayed image becomes brighter, and thus the amount of current of the entire display panel, that is, the power consumption of the panel, is increased.

In consideration of the above, in the first preferred embodiment, with respect to pixel data to be supplied to each pixel, a total sum of pixel data of an nth horizontal scan line is calculated and a difference between the total sum and a total sum of an nth horizontal scan line of the previous line is calculated. Then, based on the difference and all pixel data of an (N−1)th frame, a total value of all pixel data of an Nth frame is predicted. When the predicted value exceeds a predetermined limit, a brightness reduction ratio is set with respect to the pixel data corresponding to the nth horizontal scan line or a later horizontal scan line of the Nth frame so that the predetermined limit value is not exceeded.

In other words, it is assumed that the difference between pixel data of the nth horizontal scan line of the current frame and pixel data of the nth horizontal scan line of the previous frame continues to an (n−1)th horizontal scan line of the next frame and a panel current of one frame period later is predicted based on the assumption. Because the panel current is determined based on the pixel data to be supplied to each pixel (brightness level), the brightness of the pixel data of the nth horizontal scan line of the Nth frame is reduced so that the panel current does not exceed a predetermined limit current. It is also possible to reduce the brightness of pixel data of the nth and later horizontal scan line.

The prediction and the brightness reduction process can be represented by the following equations:

When it is determined that $$I(N-1,1)+(i(N,n)-i(N-1,n))\times k>I_{lim} \quad \text{(Equation 1)}$$

C(N,n) is set as:

$$C(N,n)=I_{lim}/(I(N-1,1)+(i(N,n)-i(N-1,n))\times k) \quad \text{(Equation 2)}$$

In the above-described equations 1 and 2, i(N,n) represents a total sum of pixel data of the nth horizontal scan line of the Nth frame;

I(N−1,1) represents a total sum of pixel data of the (N−1)th frame;

k represents a number of horizontal scan lines;

C(N,n) represents a contrast value (brightness reduction ratio) applied to the nth horizontal scan line of the Nth frame; and $I_{lim}$ represents a brightness level corresponding to a limit current (total sum of pixel data).

The limit value $I_{lim}$ is set corresponding to a panel current determined based on an upper limit of the power consumption required for the display panel. When the predicted value exceeds the limit value $I_{lim}$, if the image is displayed without processing, it is highly probable that the current would exceed the upper limit value of the panel current. Thus, an optimum brightness reduction ratio is determined based on the equation 2 with respect to the pixel data corresponding to the nth horizontal scan line of the Nth frame and is applied to the pixel data of the nth horizontal scan line so that the current does not exceed the limit value.

In the above, it is described that a unit of pixel data (brightness data) to be compared between successive frames is a horizontal scan line. The unit, however, is not limited to one line and a total sum (or an average as in the fourth alternative embodiment which will be described below) of pixel data may be compared in units of a number of lines.

Next, a display device according to the preferred embodiments of the present invention will be described referring to FIG. 1. The display device is an active matrix type (hereinafter also referred to as "active type") OLED display device which uses an OLED (organic EL) element 3 as a display element and which has a switching element in each pixel for driving the OLED element 3. FIG. 1 shows an example circuit structure of a pixel of an active type OLED panel.

The OLED element 3 comprises an EL layer between a lower electrode and an upper electrode. The EL layer comprises at least a light emitting layer having an organic light emitting compound. A single-layer structure and a multi-layer structure of three, four, or more layers including a hole transport layer, a light emitting layer, an electron transport layer, etc. may be employed as the EL layer depending on the characteristics or the like of the organic light emitting compound to be used. One of the lower electrode and the upper electrode functions as an anode and the other one of the electrodes functions as a cathode. Holes are injected from the anode into the EL layer and electrons are injected from the cathode into the EL layer. In an OLED element, the injected holes and electrons recombine in the EL layer, light emitting molecules are excited by the recombination energy, and light is emitted when the excited light emitting molecules return to the ground-state. In an active type OLED display device having such an OLED element in each pixel, the light emission luminance of an OLED element can be precisely controlled for each pixel, and thus the active type OLED display device is suitable for fine and high quality display. In an active type OLED device, one of the two electrodes of the OLED element is a pixel electrode formed in an individual pattern for each pixel and the other one of the two electrodes can be formed as a common electrode which is formed common to all pixels. In the example structure of FIG. 1, the anode is formed as an individual electrode and the cathode is formed as a common electrode.

As the switching element in each pixel, a thin film transistor (TFT) can be employed. The example structure of FIG. 1 comprises an element driving TFT 1 which is connected to the OLED element and which controls an amount of current to be supplied from a power supply PVdd to the element and a selection TFT 2 which is connected to a gate line (horizontal scan line), which is switched on when the TFT is selected by the gate line, and which reads pixel data supplied on the data line. Each pixel further comprises a storage capacitor Cs which stores, for a predetermined period, pixel data supplied via the selection TFT 2.

The element driving TFT 1 is a p-channel TFT and has a source connected to the power supply PVdd and a drain connected to the anode of the OLED element. The cathode of the OLED element is connected to a negative power supply CV. A gate of the TFT 1 is connected to the power supply PVdd via the storage capacitor Cs and is also connected via the TFT 2 to a data line (data) to which a voltage signal corresponding to pixel data (brightness data) is supplied.

The selection TFT 2 is formed by an n-channel TFT and has a gate connected to a gate line extending along the horizontal scan direction, a source connected to the data line extending along the vertical scan direction, and a drain connected to one of the electrodes of the storage capacitor Cs and to the gate of the element driving TFT 1.

In an active type OLED display device, a pixel circuit as shown in FIG. 1 is provided in each pixel and, during display, a selection signal (here, a signal of H level) is sequentially output to the horizontal scan line so that the TFT 2 connected to the horizontal scan line is switched on. In this state, pixel data is supplied to the data line, the storage capacitor Cs is charged according to the pixel data through the source and drain of the TFT 2 which is switched on, and the voltage corresponding to the pixel data is applied to the gate of the element driving TFT 1. Because the storage capacitor Cs is connected between the gate and source of the element driving TFT 1 as described above, the element driving TFT 1 operates at a voltage corresponding to the pixel data and a current corresponding to the voltage is supplied from the power supply PVdd to the OLED element.

The amount of light emission of the OLED element and a current through the OLED element are in an approximate proportional relationship. The current starts to flow through the TFT 1 when a potential difference Vgs between the gate and the source (PVdd) exceeds a predetermined threshold voltage Vth. Thus, in the pixel data to be supplied to the data line, a voltage (Vth) is added so that the drain current to be supplied to the OLED element starts to flow around the black level of the image. Moreover, the amplitude of the pixel data is adjusted so that a predetermined brightness is achieved near the white level of the image.

Figure 2:
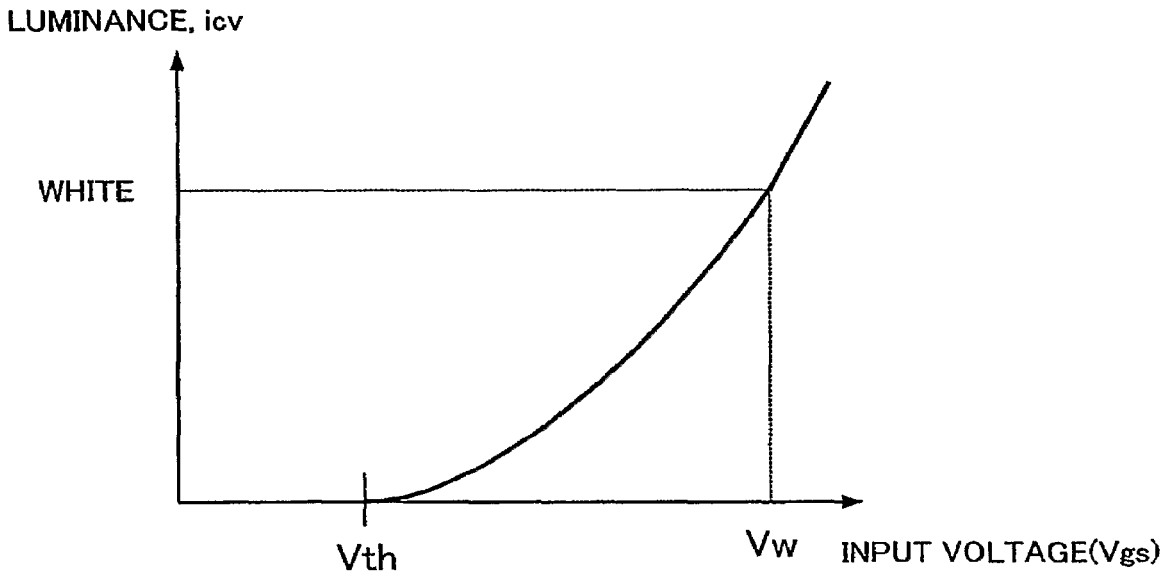
FIG. 2 is a diagram of a relationship between an input voltage (Vgs) applied to a gate of an element driving TFT and luminance of an OLED element and a current icv.

FIG. 2 is a diagram showing a relationship between an input voltage (Vgs) applied to the gate of the TFT 2 and the light emission brightness of the OLED element and the current icv of the OLED element. The current icv is a cathode current. The OLED element is set so that the OLED element starts to emit light when the voltage Vgs reaches the voltage Vth and the brightness becomes a predetermined brightness at an input voltage indicating the white level. Because the input voltage Vgs corresponds to the pixel data output on the data line as described above, the light emission brightness and the amount of current of the corresponding OLED element can be predicted through analysis of the pixel data.

The display device to which the driving device and the driving method of the present embodiment may be used is not limited to an active type OLED display device, and similar advantages can be achieved in an passive OLED display device in which no switching element is provided for each pixel, by controlling the brightness reduction ratio of pixel data to be supplied to each pixel based on a comparison of pixel data between lines as described above. In addition, the display device is not limited to the OLED display device and the present invention may be applied to an inorganic EL (LED) display device which uses an inorganic light emitting material, PDP, etc. The present invention can also be applied to a liquid crystal display device. However, the present invention can reliably and quickly achieve very high reduction advantages with a simple structure by being applied to a display device in which the light emission luminance is determined according to the current or the like to be supplied to the pixel and the power consumption of the panel is determined according to the light emission luminance.

Figure 3:
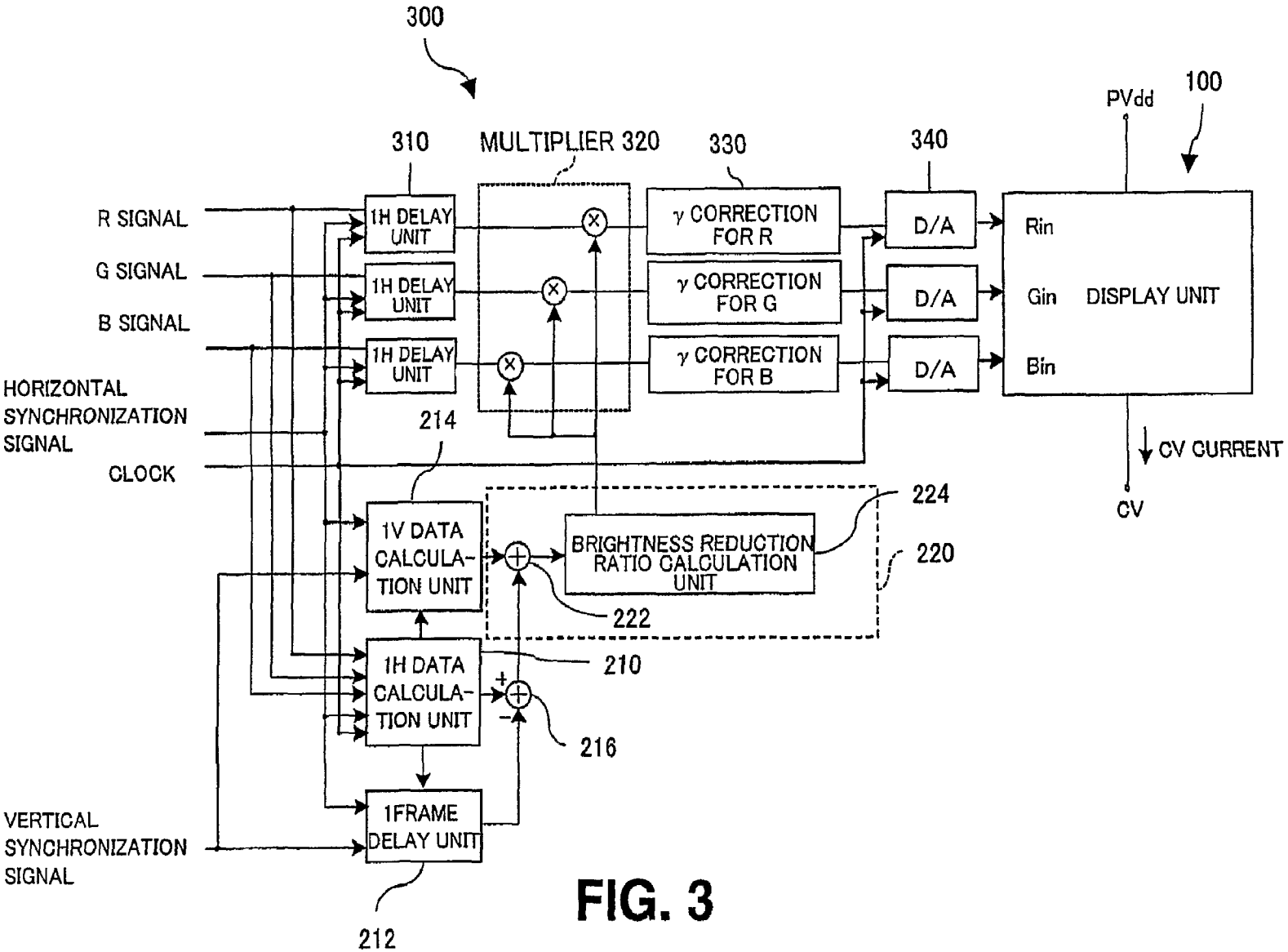
FIG. 3 is a diagram showing an example structure of a driving device for a display device according to a first preferred embodiment of the present invention.

A structure of a driving device (driving circuit) 300 for display device according to the first preferred embodiment will now be described referring to FIG. 3. A display panel 100 is an OLED display panel in which pixels each having a circuit structure as shown in FIG. 1 are arranged in a matrix form. The driving device of the present embodiment creates, based on input video signals of R, Q and B having no γ characteristic and having a linear characteristic, pixel data suitable for display on the OLED display panel 100 with the structure as will be described below.

The R, G, and B video signals input to the device 300 are supplied to a line data calculation unit 210 and a 1H (one horizontal scan period) delay unit 310 provided for each of R, G, and B as will be described below. The line data calculation unit 210 multiplies the R, G, and B video signals, which are sequentially input, by a coefficient corresponding to the light emission efficiency of each color based on a horizontal synchronization signal and a clock, to calculate a sum (a total sum) of one line (one horizontal scan period) of pixel data corresponding to an nth horizontal scan line of an Nth frame. The calculated line sum data i(N,n) is output to a comparative calculation unit 216 and also to a frame delay unit 212 and a 1V data summation unit 214. The frame delay unit 212 delays the line sum data i(N,n) from the line data calculation unit by 1V period based on a vertical synchronization signal which is supplied once every vertical scan (V) period and a horizontal synchronization signal which is supplied once every horizontal scan (H) period and outputs the delayed data to the comparative calculation unit 216.

The comparative calculation unit 216 applies a comparative calculation to the line summation data i(N,n) and the line summation data i(N−1,n) corresponding to the nth horizontal scan line of the previous frame ((N−1)th frame) obtained from the frame delay unit 212. As the comparative calculation, in the first preferred embodiment, difference data [i(N,n)−i(N−1,n )] is calculated.

The 1V data calculation unit 214 is an adder unit that sequentially adds the line summation data for each 1H sequentially supplied from the line data calculation unit 210 and calculates a total sum of the line summation data for 1V period (1 frame), that is, for all horizontal scan lines of the panel, based on the horizontal synchronization signal and the vertical synchronization signal. In the present embodiment, the 1V data calculation unit 214 calculates a total sum I(N−1,1) of the line summation data of the (N−1)th frame which is a frame before the processing target frame.

A brightness determination unit 220 comprises a frame data prediction unit 222 and a brightness reduction ratio calculation unit 224. The difference data [i(N,n)−i(N−1,n)] from the comparative calculation unit 216 and the total sum I(N−1) of the pixel data of the (N−1)th frame from the 1V data summation unit 214 are supplied to the frame data prediction unit 222. The frame data prediction unit 222 multiplies the difference data [i(N,n)−i(N−1,n)] by the number k of all horizontal scan lines to calculate a change value (i(N,n)−i(N−1,n)×k and adds the total sum I(N−1,1) of the pixel data of the (N−1)th frame to the change value. In this manner, a predicted value [I(N−1,n)+(i(N,n)−i(N−1,n))×k]] of the pixel data of the Nth frame is obtained.

The calculated predicted value is output to the brightness reduction ratio calculation unit 224. The brightness reduction ratio calculation unit 224 determines whether or not the predicted value exceeds the brightness level $I_{lim}$ corresponding to the limit current (total sum of pixel data) (refer to equation 1). When the predicted value exceeds $I_{lim}$, a brightness reduction ratio (contrast value) [C(N,n)] to be applied to the pixel data of the nth horizontal scan line of the Nth frame is calculated according to the equation 2 for each of R, G, and B.

The calculated brightness reduction ratio for each of R, G, and B is output to a multiplier 320. The multiplier 320 receives, as an input, pixel data of the nth horizontal scan line of the Nth frame of the input video signal delayed by 1H by the 1H delay unit 310 and multiplies the pixel data by the brightness reduction ratio.

The 1H delay unit 310 is a line buffer for setting the line for which a calculation is to be performed to be equal to the display line. The 1H delay unit 310 may be omitted, but is preferably provided for various reasons such as, for example, achieving a brightness reduction process with a higher precision and reliably reducing the power consumption. However, even when the 1H delay unit 310 is omitted, the difference between the calculation target and the display target is only 1H and the probability that the brightness level will change rapidly in 1H period is low. Therefore, the influence of omitting the 1H delay unit 310 is small compared to a configuration in which the frame memory is omitted in the method of the related art.

The R, G, and B pixel data multiplied by the brightness reduction ratio in the multiplier 320 are supplied to γ correction units 330 for R, G, and B, respectively. The γ correction unit 330 corrects the input pixel data according to a current-brightness characteristic or the like of each OLED element of the display panel 100 and outputs γ corrected pixel data which cause a display at an optimum brightness on the OLED element for any display gradation. The γ corrected pixel data is then converted to analog pixel data to be supplied to each pixel of the display panel 100 by a digital-to-analog (D/A) converter 340. When the input video signal is an analog signal and the calculation is not digitally processed, the D/A converter 340 may be omitted.

The pixel data to which the brightness reduction process and γ correction are applied is then supplied to a corresponding data line of the display panel 100 (refer to FIG. 1) and a current corresponding to the pixel data is supplied to the corresponding OLED element. The current is limited to a desired level. In the present embodiment, the cathode of the OLED element is formed as a common electrode and current which flows through the OLED elements from the common cathode (CV current) corresponds to the current of the overall panel. In other words, in the present embodiment, the current flowing from the common cathode of the OLED element is limited to not exceed a limit level, so that the light emission luminance of the OLED elements is limited to a suitable level and the power consumption of the overall panel is reduced.

Figure 4:
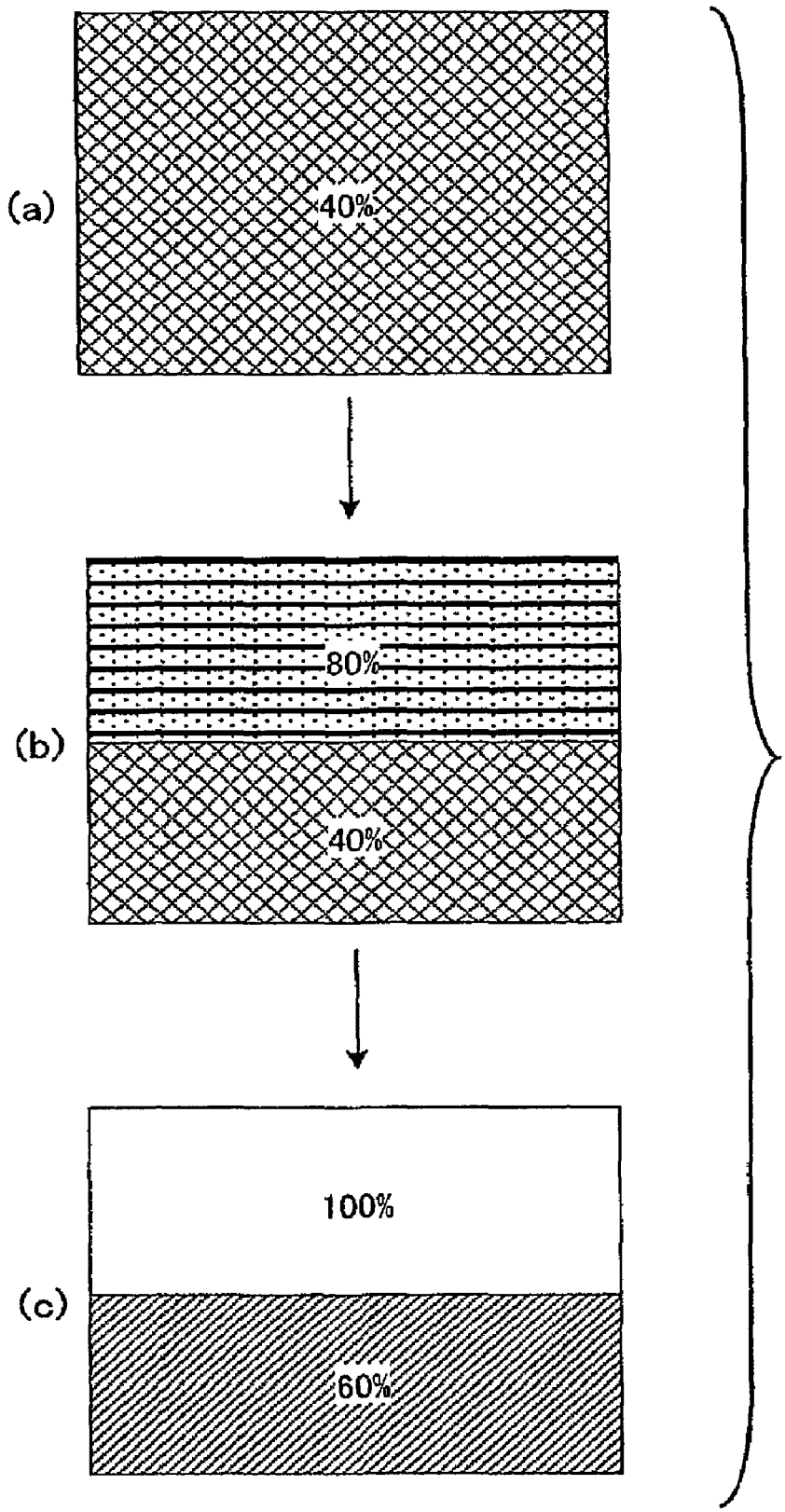
FIGS. 4A-4C are diagrams showing a state of change of brightness on a screen of a display panel.

Next, a change of brightness of the OLED panel and a change with respect to time of the panel current will be described referring to a simple displayed image. FIG. 4 shows a state of change of brightness on a screen of the display panel. FIG. 4A is an initial display image of brightness of 40% over the entire screen, FIG. 4B is a state in which the brightness of the upper half of the image is changed from the state of FIG. 4A to brightness of 80%, and FIG. 4C is a state in which the brightness of the upper half of the image is changed from the state of FIG. 4B to brightness of 100% and the brightness of the lower half of the image is changed from the state of FIG. 4B to brightness of 60%.

Figure 5:
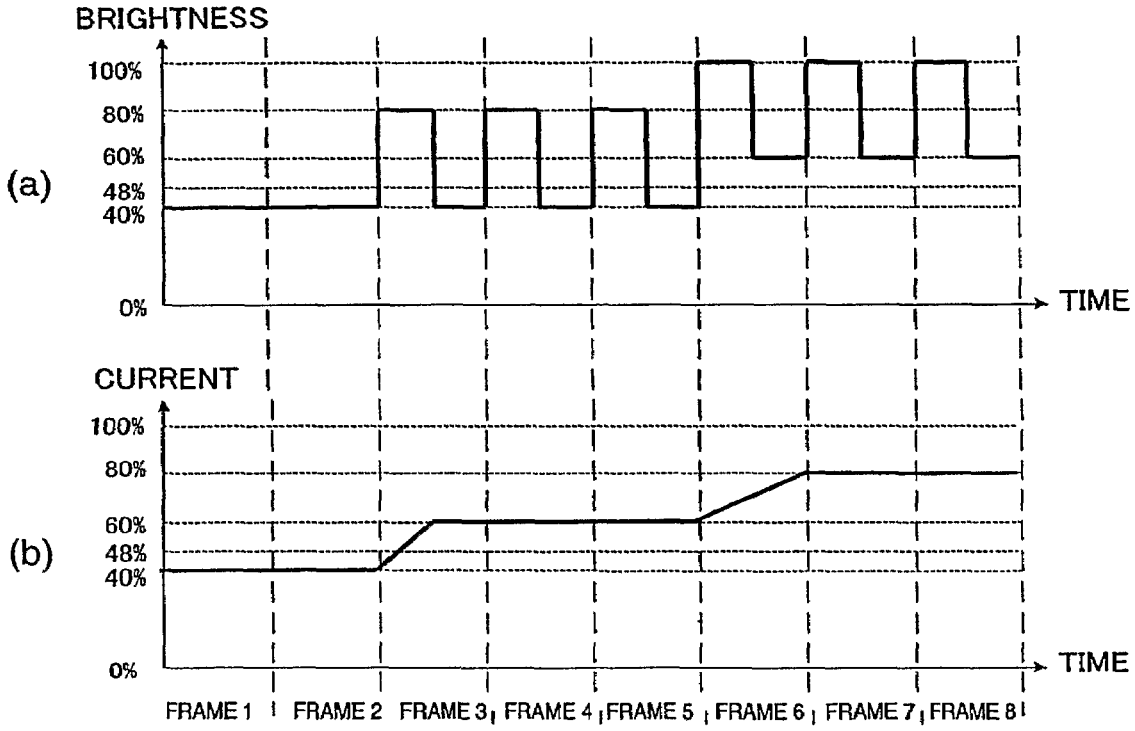
FIGS. 5A-5B are diagrams showing brightness change of pixel data and a change, with respect to time, of a panel current when no brightness reduction process is applied in a case where the brightness changes as in FIG. 4.

FIG. 5 shows a change of brightness of pixel data and a change of panel current value when the brightness changes as shown in FIG. 4. In FIG. 5, no brightness reduction process is applied. When the light emission of the overall screen is at brightness of 40% with the maximum light emission brightness being set as 100%, a current of 40%, with 100% being the maximum panel current, flows as the panel current. When the brightness of the upper half of the screen changes to 80% in a third frame as shown in FIG. 4B, the panel current is increased from 40% and reaches and stays at a current amount of 60% corresponding to the average brightness of one frame period. When the brightness of the upper half of the screen changes to the brightness of 100% and the brightness of the lower half of the screen changes to 60% in a sixth frame as shown in FIG. 4C, the panel current is increased from 60% to 80%.

Figure 6:
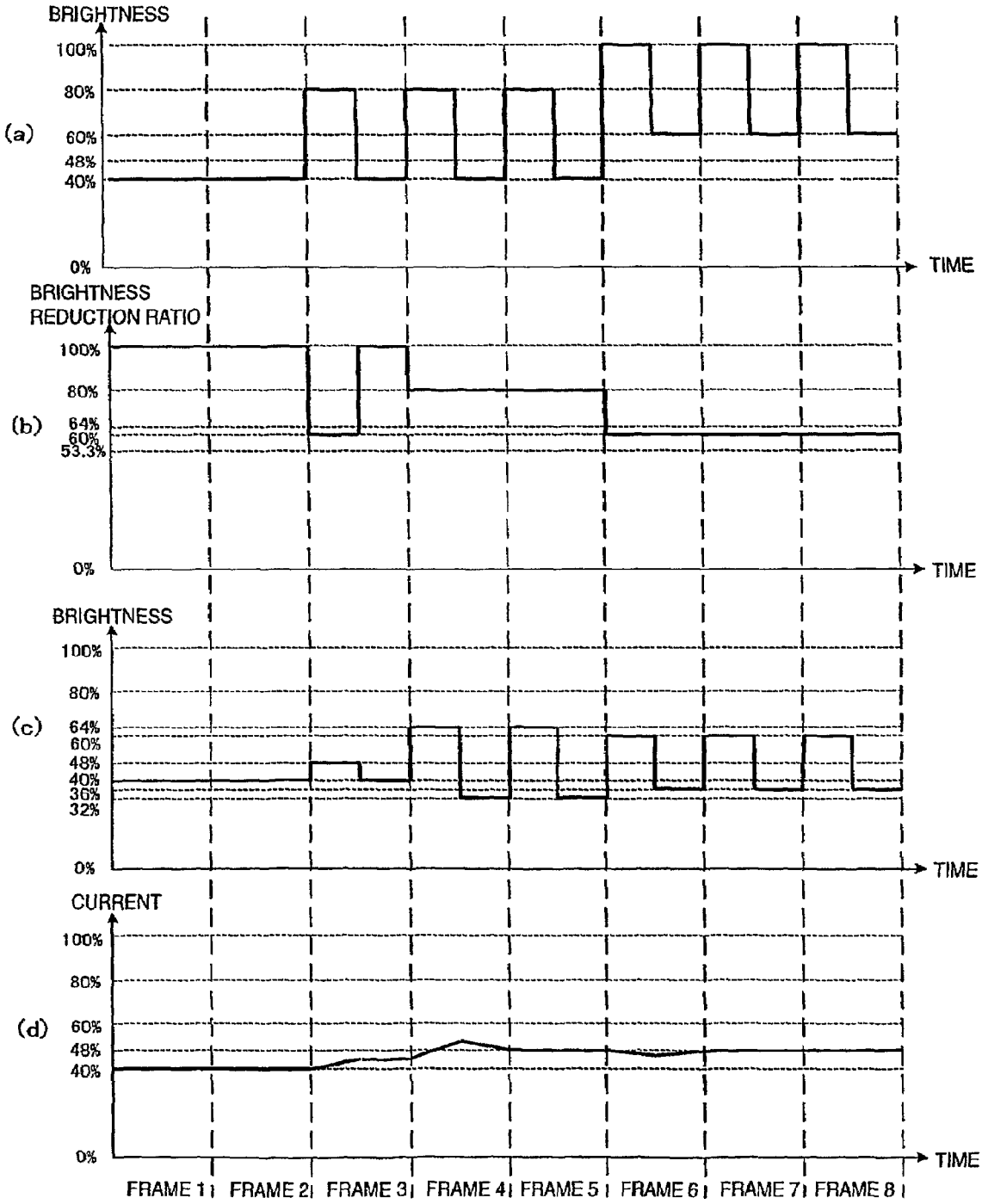
FIGS. 6A-6D are diagrams showing a change, with respect to time, of brightness of pixel data, brightness reduction ratio, and panel current when a brightness reduction process is applied by a driving method of the first preferred embodiment of the present invention.

FIG. 6 shows a change with respect to time of the brightness reduction ratio, pixel data corresponding to the brightness reduction ratio, and panel current when the brightness reduction process is applied through the driving method according to the present embodiment. FIG. 6A shows a change of brightness of pixel data input to the driver circuit and is identical to FIG. 5A. In the third frame, a difference between a total sum of pixel data of the nth horizontal scan line (in the case of the upper half of the panel) and a total sum of the pixel data of the same line in the second frame corresponds to 40% of the maximum brightness in terms of the brightness level and the total sum (brightness) of the pixel data of the Nth frame calculated based on the difference is predicted to be approximately twice (brightness of 80% of maximum value) the total sum (brightness) of pixel data of the (N−1)th frame. When the limit level $I_{lim}$ of the brightness is set at 48%, the obtained predicted value exceeds the limit level, and thus the brightness reduction ratio C(N,n) is set to 60% with respect to the original pixel data as shown in FIG. 6B.

Therefore, the pixel data (brightness level) to which such a brightness reduction ratio is applied is limited to not exceed the brightness of 48% which is the limit value as shown in FIG. 6C. The panel current in this case is also limited to 48% or smaller of the maximum value which is the target.

In the later half of the third frame (lower half of the screen), the display image is at brightness of 40% and the total value of the pixel data of all frames is also at brightness of 40%. Therefore, the brightness reduction ratio is set at 100%, that is, no reduction process is applied.

In the next frame, that is the fourth frame, the pixel data identical to that in the third frame is supplied and the difference in 1H data of the equation 2 becomes 0. Because the average brightness level during the third frame period is 60%, the brightness reduction ratio is set to 80% as shown in FIG. 6B in both the first half and second half of the fourth frame. Therefore, the brightness level of the pixel data supplied to the panel 100 is limited to 64% in the first half and to 32% in the second half as shown in FIG. 6C. During the fourth frame period, the limit current of 48% is temporarily exceeded as shown in FIG. 6D, but the degree of the excess is very small and the period during which the limit current is exceeded is short. Thus, on average over the fourth frame, the current is limited to a value of around 48% which is the limit current. During a fifth frame, which is the next frame, the brightness reduction ratio is set identical to that during the fourth frame. The brightness of the pixel data of the fourth frame to which the brightness reduction is applied (second half) is 32% and the panel current is maintained at 48% over the entire frame period as shown in FIG. 6D.

During a sixth or later frame, the display image has brightness of 100% at the upper half and 60% at the lower half as shown in FIG. 4A. In this case, a brightness reduction ratio of 60% is applied and the brightness level of the pixel data after the brightness reduction is applied becomes 60% during the first half of the frame and 36% during the second half of the frame as shown in FIG. 6C, and thus the panel current is limited to a value of 48% or less. Even when the brightness is limited, regarding the contrast ratio which significantly affects the display quality, the contrast ratio of the original pixel data is maintained, and thus degradation of display quality due to reduction in brightness is prevented.

Figure 7:
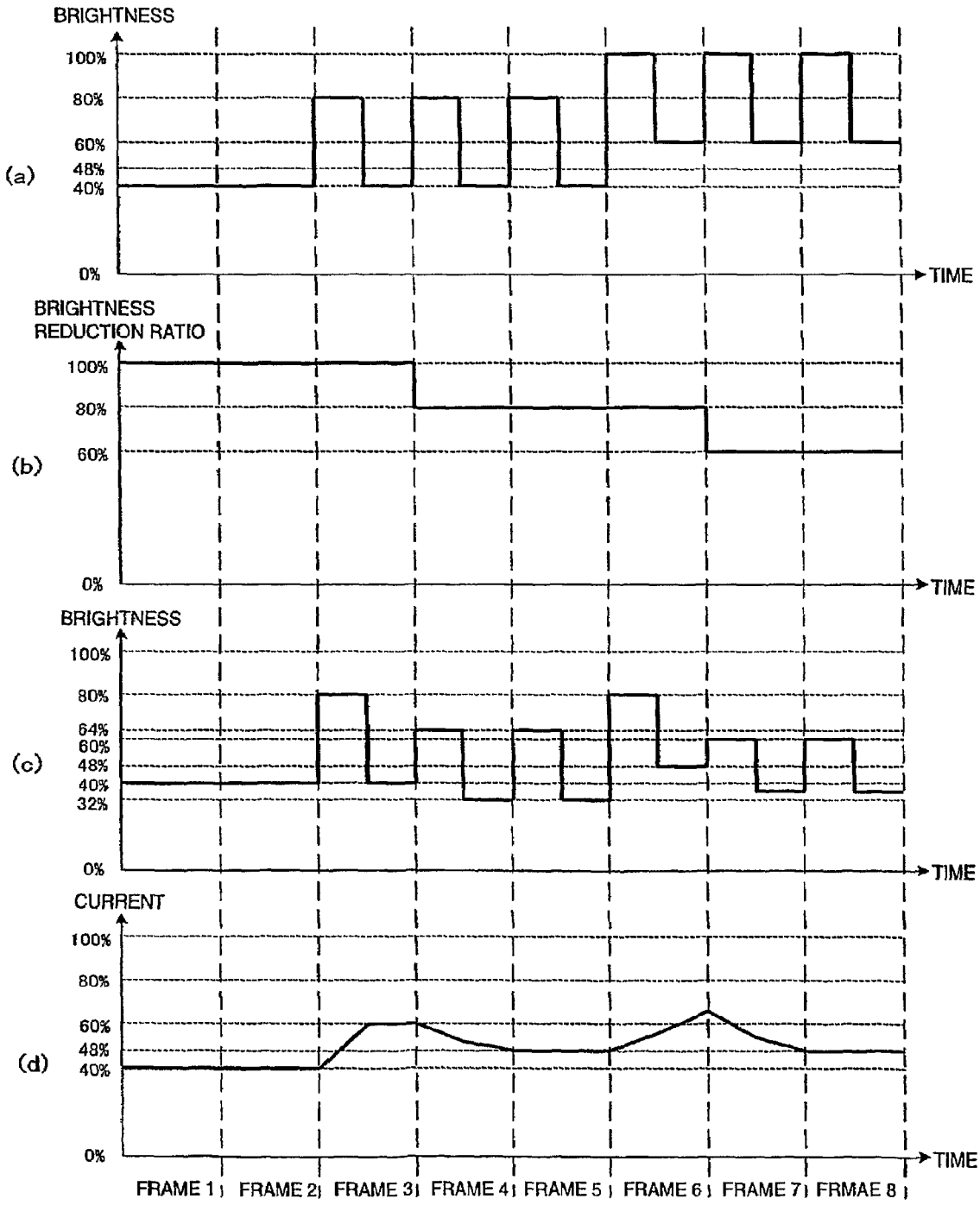
FIGS. 7A-7D are diagrams showing a change, with respect to time, of brightness of pixel data, brightness reduction ratio, and panel current when a brightness reduction process is executed in a comparative example.

Next, a comparative example will be described referring to FIG. 7. In the comparative example, a method similar to the related art is employed in which pixel data is stored in units of frames, average brightness of the data is calculated, and a predetermined brightness reduction process is applied to the pixel data in units of frames. In the comparative example, the frame memory is omitted. The limit current of the panel current in the comparative example is set to 48%, similar to the first preferred embodiment.

Input image data is shown in FIG. 7A and is identical to that shown in FIG. 5A. The input image data shows a case in which the brightness change occurs as shown in FIG. 4. Because the frame memory is omitted, the brightness reduction ratio of the current frame is set based on the average brightness of the previous frame. That is, as shown in FIG. 7B, even when the image having the light emission brightness of 40% over the entire region until the second frame changes to an image in which the upper half has a brightness of 80% and the lower half has a brightness of 40% in the third frame, the brightness reduction ratio of 100% which is the brightness reduction ratio of the second frame is still used. Therefore, the brightness level of the pixel data supplied to the panel is not limited and will be 80% at the first half and 40% at the second half as indicated in the current data. Thus, the panel current is increased during the third frame period from 40% and exceeds the panel current limit value of 48%, and reaches 60% where the panel current stays, as shown in FIG. 7D. In the fourth frame, the brightness reduction ratio is set to, for example, 80% (refer to FIG. 7B) based on the original pixel data of the third frame, and the brightness level of the pixel data is limited to 64% in the first half of the fourth frame and to 32% in the second half of the fourth frame (refer to FIG. 7C). In this case also, the panel current does not immediately become 48% or less, and in the example of FIG. 7D, the panel current is reduced to the limit current of 48% at the fifth frame. Thus, the panel current exceeds the limit current by a significant amount during the two frames of the third and fourth frames.

In the sixth frame in which the display image is changed from an image in which the upper half has a brightness of 80% and the lower half has a brightness of 40% to an image in which the upper half has a brightness of 100% and the lower half has a brightness of 60%, the brightness reduction process is again delayed by one frame. Therefore, in this case also, the panel current would exceed the limit level of 48% by a significant amount. In the example shown in FIG. 7D, the panel current is increased to a maximum of nearly 70% during two frame periods of the sixth frame and the seventh frame. When the panel current exceeds the limit current by a large amount and for a long period of time, the maximum power consumption cannot be reduced. In addition, in the fourth and seventh frames, for example, an image of the same brightness as the previous frame should be displayed, but in reality, a very large change in brightness occurs in these frames. It is highly probable that such a large change in brightness will be recognized by the viewer of the display device and is determined as significant degradation of display quality. Therefore, when the brightness reduction ratio is to be set based on comparison of data in units of frames as in the related art, the frame for which the brightness reduction ratio is to be calculated and the frame in which the data is actually output to the panel must coincide. As a result, the frame memory cannot be omitted and the requirement of reducing the cost and size for the driving device cannot be satisfied.

When the driving method of the first preferred embodiment of the present invention is used, on the other hand, basically only a memory that stores data of 1H (line data calculation unit 210, 1H delay unit 310) may be provided as the memory for adjusting the brightness. Other data necessary for calculation can be obtained by delaying the summation data or by accumulatively summing. Therefore, the brightness reduction process can be realized with a very simple structure. In addition, because the brightness reduction ratio can be determined when pixel data of one horizontal scan line are compared between two successive frames, the process can be very rapid. Moreover, because the brightness reduction process is applied for each line, the maximum power consumption of the panel can be reliably reduced without degrading the display quality.

In order to drive an OLED panel, a power supply is required which is capable of supplying a current necessary for display of an image of a maximum brightness over the entire screen. Because of this, a power supply with a much larger margin than a power supply capability required for normal usage is required. In addition, in a display device which primarily displays a natural image such as a display device in a digital camera (DSC) and a video camera (DVC), the average level of pixel data is typically approximately 25% with respect to the maximum light emission brightness and the maximum current of the power supply is seldom used. In other words, when the OLED panel is used as a display device for displaying a natural image, a power supply having a high capability that can achieve the maximum brightness of 100% is used, although the brightness of 100% is seldom used.

In the first preferred embodiment, because the panel current can be sufficiently and reliably inhibited, it is possible to use a power supply having a low current driving capability and low power consumption, and thus the first preferred embodiment can significantly contribute to reduction of the power consumption of the overall display device. In addition, in general, power supplies with lower capability have smaller area. Therefore, it is possible to reduce the size of the overall device. Consequently, the driving device of the first preferred embodiment can achieve a very high advantage when used as the driving device of a display device for DSC and for DVC.

As described above, the lifetime of the current OLED element tends to be shorter as the period of high brightness light emission becomes longer. By reliably inhibiting the panel current as in the present embodiment, it is possible to prolong the lifetime of the element.

Second Preferred Embodiment

In the above-described first preferred embodiment, a total sum of pixel data for 1H is calculated, a difference is calculated as comparative calculation with respect to pixel data of the corresponding line of the previous frame, and brightness is predicted (current is predicted) assuming that the difference continues to the (n−1)th horizontal line of the next frame. In the second preferred embodiment, on the other hand, a ratio of pixel data is calculated as the comparative calculation instead of the difference of the pixel data and the current value of one frame later being predicted. This process can be represented by the following equation:

When it is determined that $$I(N-1,1)\times i(N,n)/i(N-1,n)>I_{lim} \quad \text{Equation 3}$$

C(N,n) is set as:

$$C(N,n)=I_{lim}/(I(N-1,1)\times(i(N,n)/i(N-1,n)) \quad \text{Equation 4}$$

In addition, in the second preferred embodiment, in order to avoid extreme operations, when the ratio i(N,n)/i(N−1,n) exceeds a set value a and when i(N−1,n) is 0, the ratio is set as:

$$i(N/n)/i(N-1,n)=a \quad \text{Equation 5}$$

Figure 8:
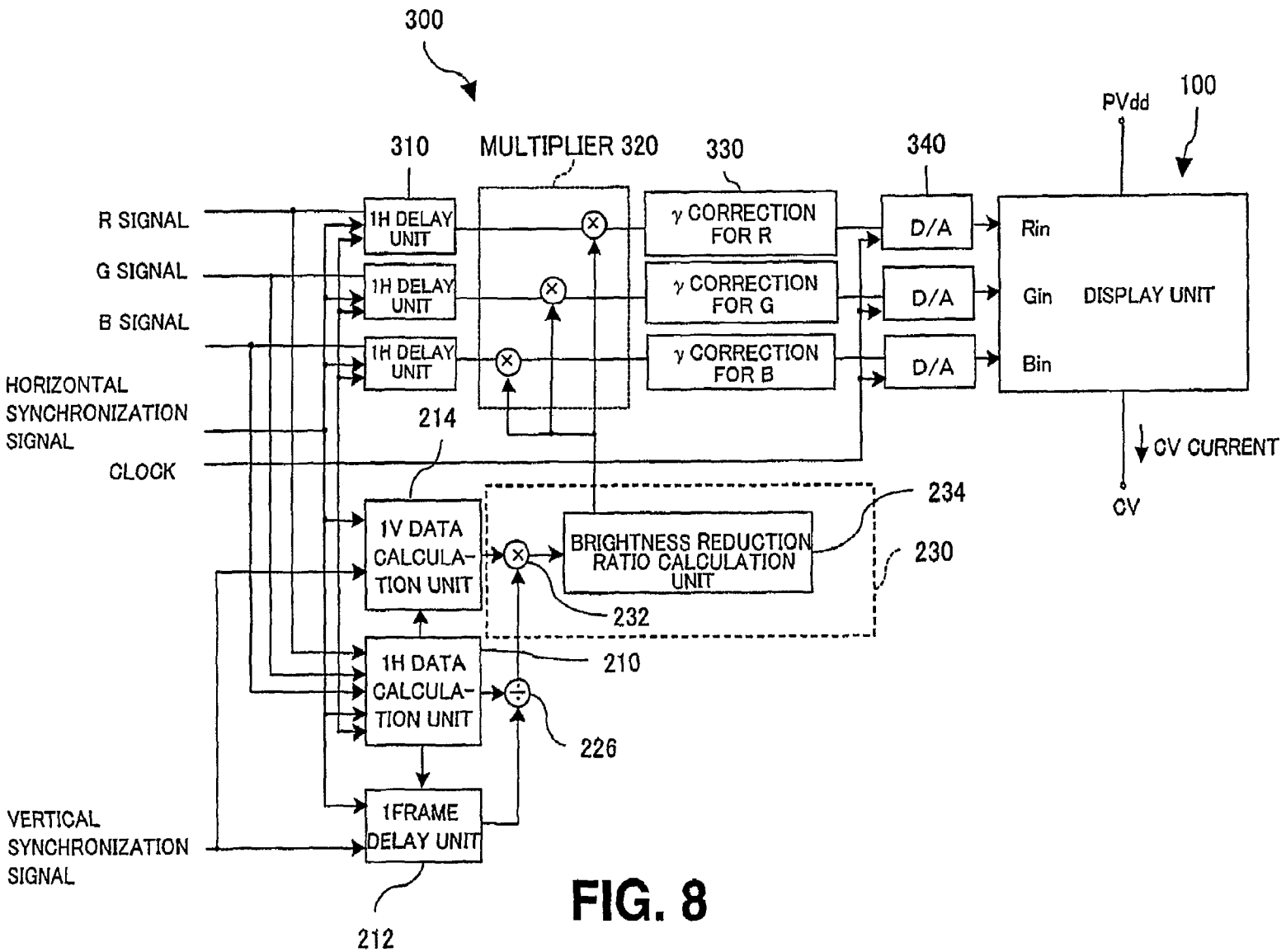
FIG. 8 is a diagram showing an example structure of a driving device for a display device according to a second preferred embodiment of the present invention.

FIG. 8 schematically shows an example structure of a driving device which executes the above-described driving method. The driving device of FIG. 8 differs from that of the first preferred embodiment in that a comparative calculation unit 226 of FIG. 9 calculates a ratio i(N,n)/i(N−1,n) between the sum i(N,n) of pixel data of the nth horizontal scan line of the Nth frame and sum i(N−1,n) of pixel data of the nth horizontal scan line of the (N−1)th frame from a frame delay unit 212 whereas the comparative calculation unit 216 of FIG. 3 calculates a difference in line data. The calculated ratio is supplied to a frame data prediction unit 232 which multiplies the total sum I(N−1,1) of pixel data of the (N−1)th frame supplied from the IV data calculation unit 214 and the ratio i(N,n)/i(N−1,n), so that a predicted value of a total sum of pixel data at the Nth frame is calculated.

A brightness reduction ratio calculation unit 234 determines whether or not the predicted value exceeds the limit brightness level $I_{lim}$ based on the equation 3. When the predicted value exceeds the limit brightness level $I_{lim}$, a brightness reduction ratio (contrast value) [C(N,n)] for each of R, G, and B to be applied to the pixel data of the nth horizontal scan line of the Nth frame is calculated according to equation 4. Similar to the first preferred embodiment, the brightness reduction ratio is multiplied, at the multiplier 320, by the pixel data of each of R, G, and B of the nth horizontal scan line of the Nth frame of a video signal delayed by a 1H period. At the pixels of the corresponding nth horizontal scan line of the display panel 100, display is realized at a reduced brightness.

Figure 9:
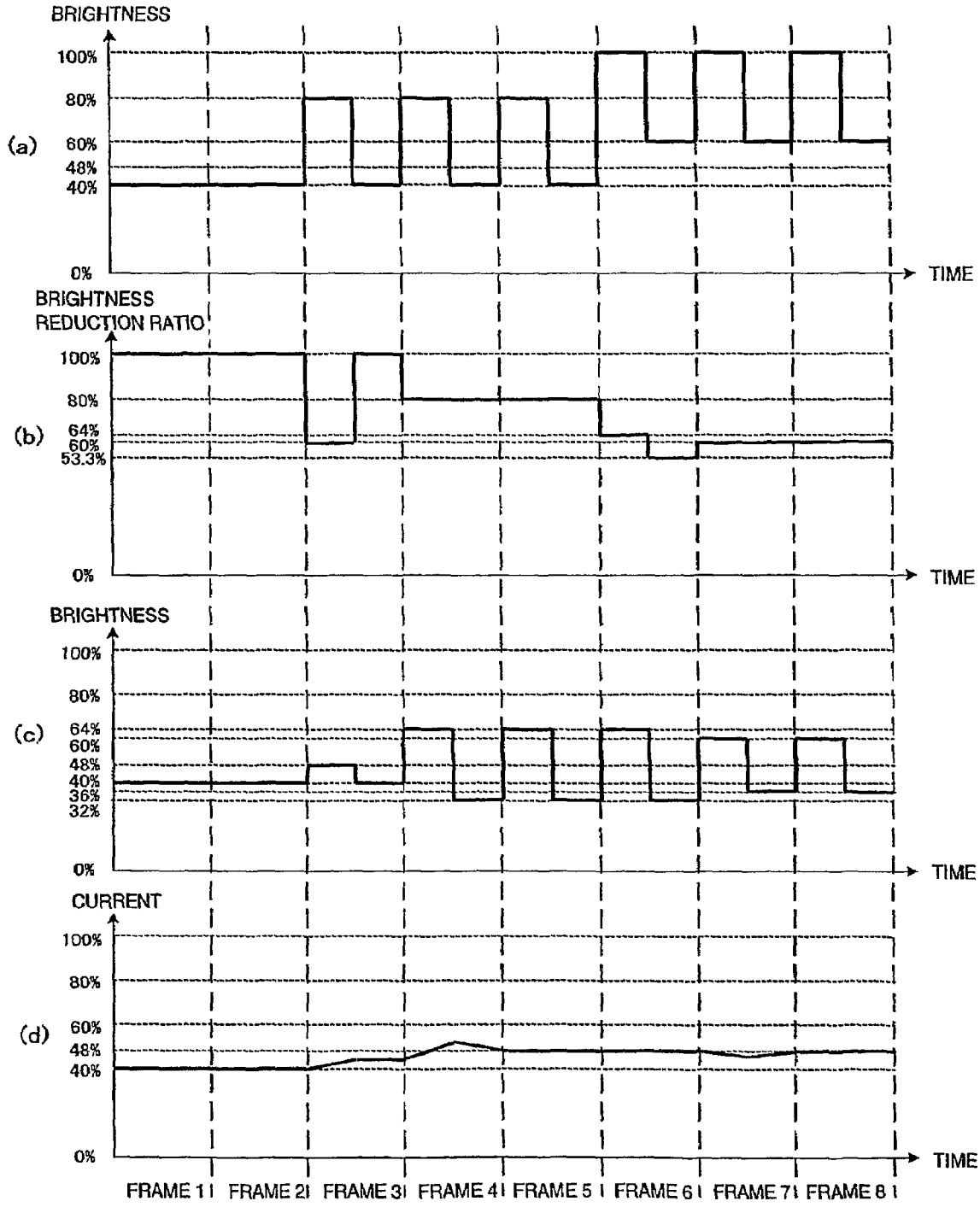
FIGS. 9A-9D are diagrams showing a change, with respect to time, of brightness of pixel data, brightness reduction ratio, and panel current when a brightness reduction process is executed by a driving method of the second preferred embodiment of the present invention.

FIG. 9 shows a change, with respect to time, of the brightness of pixel data, brightness reduction ratio, and panel current processed by the driving device of FIG. 8. FIG. 9A shows a waveform of pixel data identical to that of FIG. 6A and a brightness reduction ratio as shown in FIG. 9B is set with respect to the pixel data according to a ratio of pixel data of 1H line between successive frames.

The brightness reduction ratio coincides with the set value of FIG. 6B except for the sixth frame. In the sixth frame, the brightness reduction ratio differs from that of FIG. 6B because a ratio is used. However, as is clear from a comparison with FIG. 6C, the waveform of the pixel data to which such a brightness reduction ratio is applied is closer to the change of brightness of the original pixel data. In addition, as is clear from a comparison between FIGS. 6D and FIG. 9D, the panel current is almost identical except for a small difference in the waveform of the sixth and seventh frames and is almost always maintained at the limit value of 48% or less.

Third Preferred Embodiment

In the above-described first preferred embodiment, the 1V data calculation unit 214 calculates a sum of all pixel data of the (N−1)th frame as a reference value of the frame data used in the prediction calculation. In the third preferred embodiment, on the other hand, a total sum of pixel data from the nth horizontal scan line of one frame before the current frame to the (n−1)th horizontal scan line of the current frame is calculated. The other structures and processes are identical to those in the first preferred embodiment. The prediction and the limitation processes in the third preferred embodiment can be represented by the following equations:

When it is determined that $$I(N-1,n)+(i(N,n)-(i(N-1,n))\times k>I_{lim} \quad \text{Equation 6}$$

C(N,n) is set as:

$$C(N,n)=I_{lim}/(I(N-1,n)+(i(N,n)-i(N-1,n))\times k \quad \text{Equation 7}$$

Here, I(N−1,n) represents a total sum of pixel data from the nth horizontal scan line of the (N−1)th frame to the (n−1)th horizontal scan line of the Nth frame.

Figure 10:
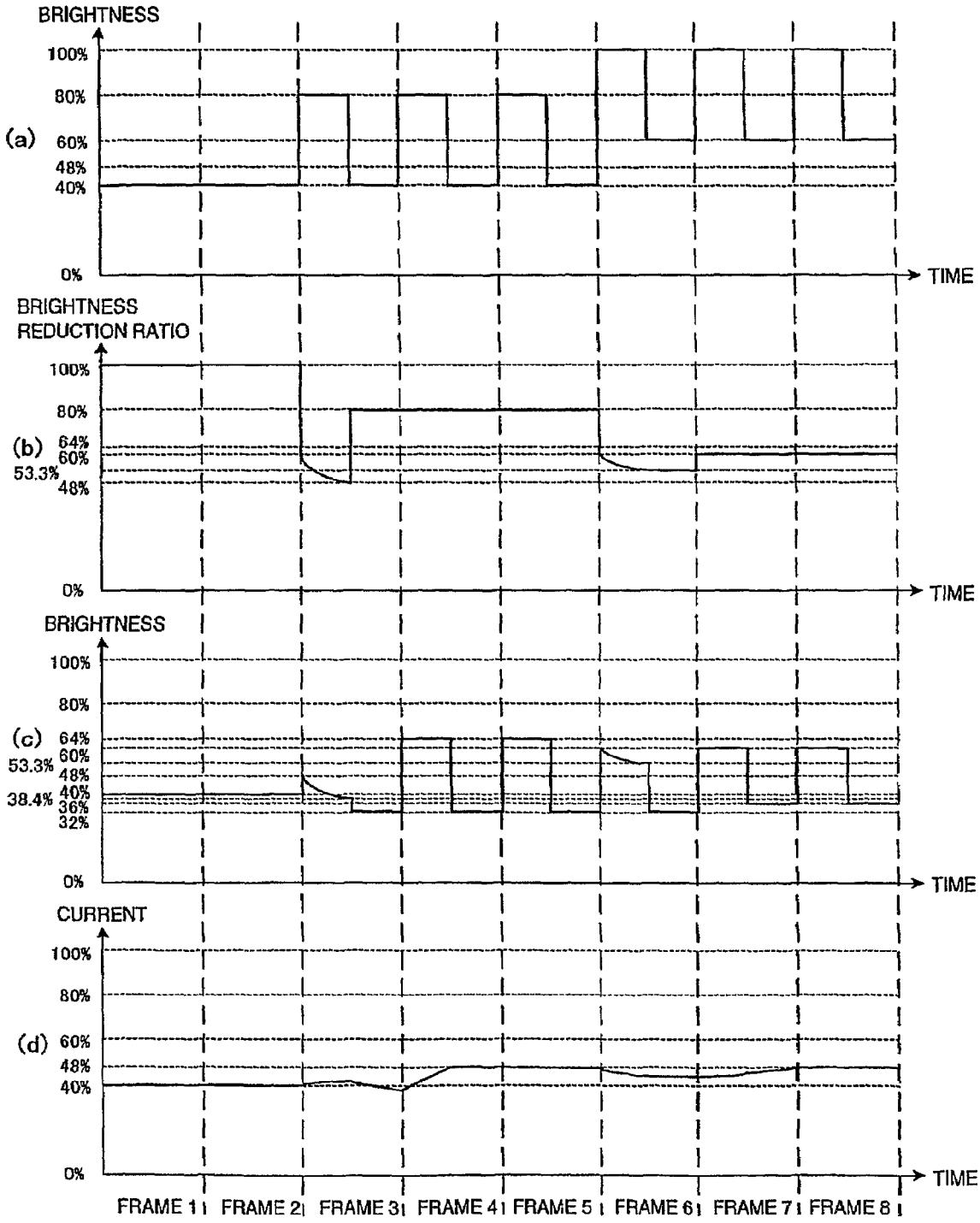
FIGS. 10A-10D are diagrams showing a change, with respect to time, of brightness of pixel data, brightness reduction ratio, and panel current when a brightness reduction process is executed using a driving method of a third preferred embodiment of the present invention.

FIG. 10 shows a change of brightness of the pixel data, brightness reduction ratio, and panel current of the third preferred embodiment. The input pixel data of FIG. 10A is identical to that of FIG. 5A. With respect to such input pixel data, a reference value is adjusted for each line using the sum of the pixel data from the nth line of the (N−1)th frame to the (n−1)th line of the Nth frame as the reference frame data. Thus, the brightness reduction ratio is also set for each line as shown in F*ig*. 10B. Therefore, a suitable brightness reduction process is applied for each line of the pixel data as shown in FIG. 10C, and it is possible to reliably prevent the panel current from exceeding the limit value of 48% (refer to FIG. 10D).

It is also possible to use, in the second preferred embodiment, the total sum of pixel data from the nth horizontal scan line of one frame before the current frame to the (n−1)th horizontal scan line of the current frame as in the third preferred embodiment, as the reference value of the frame data used in the prediction calculation.

The process in this case can be represented by the following equations:

When it is determined that:

$$I(N-1,1)\times i(N,n)/i(N-1,n)>I_{lim} \quad \text{Equation 8}$$

C(N,n) is set as:

$$C(N,n)=I_{lim}/(I(N-1,n)\times i(N,n)/i(N-1,n)) \quad \text{Equation 9}$$

The brightness reduction can be reliably executed for each line and the panel current can be limited also in this manner by determining the brightness reduction ratio using the ratio of line data and frame data until the (n−1)th horizontal scan line which is immediately before the current frame.

Other Alternative Embodiments

First Alternative Embodiment

Figure 11:
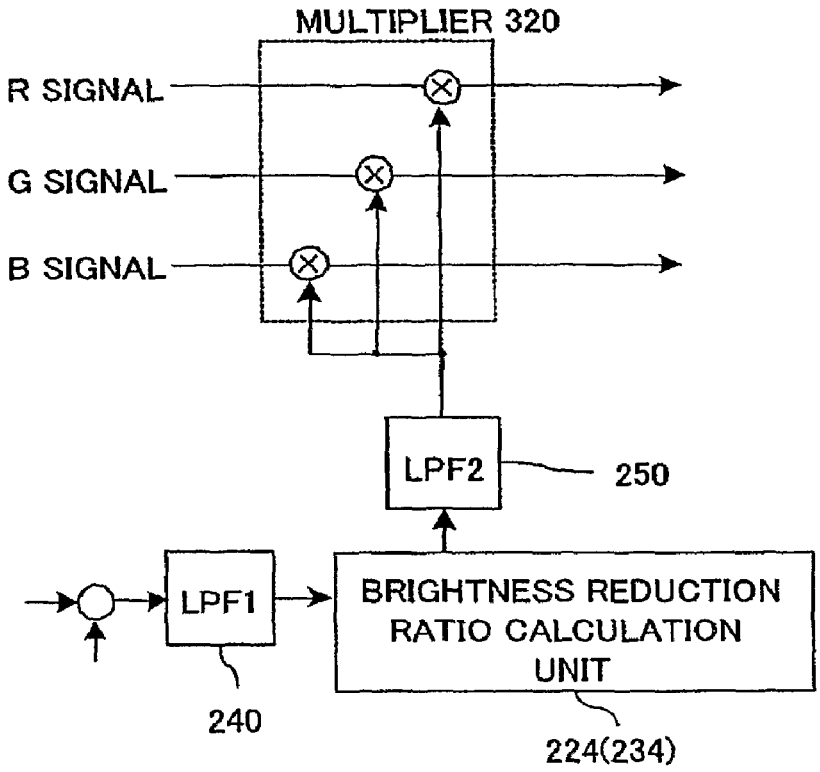
FIG. 11 is a diagram for explaining a first alternative embodiment of the present invention.

In the first alternative embodiment, low pass filters 240 and 250 (LPF1 and LPF2) as shown in FIG. 11 are inserted upstream and downstream of the brightness reduction ratio calculation units 224 and 234 described above with reference to the first through third preferred embodiments, and a final brightness reduction ratio is determined.

In the first through third preferred embodiments, the brightness reduction ratio is determined for each 1H using the result of the comparative calculation of one line data and 1V data. When the scene of the imaging target rapidly and changes significantly, the predicted value becomes significantly different from the actual value and may change by a significant amount line by line. By providing an LPF upstream and downstream of the rightness reduction ratio calculation unit as in the first alternative embodiment, it is possible to prevent execution, on the pixel data of the nth line of the Nth frame, of a brightness reduction process which significantly differs from the pixel data of the line which is immediately before the nth line of the Nth frame.

As the filter 240 at the input side of the brightness reduction ratio calculation units 224 and 234, it is possible to use a filter which averages, for example, a few lines to a few tens of lines with respect to the predicted value supplied from the frame data prediction units 222 and 232.

Figure 12:
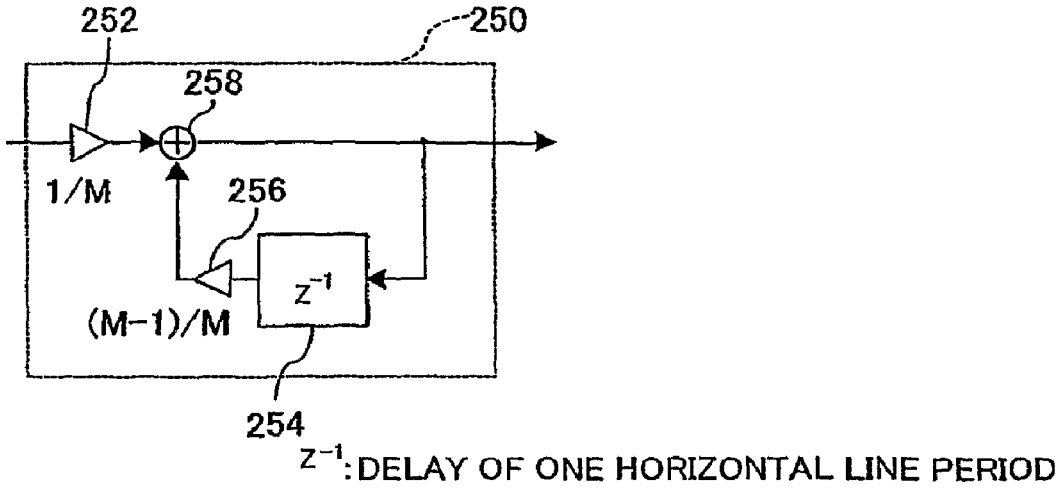
FIG. 12 is a diagram showing an example structure of an LPF 2.

As the filter 250 provided at the output side of the brightness reduction ratio calculation units 224 and 234, it is possible to use a structure as shown in, for example, FIG. 12. The filter 250 comprises an amplifier 252 having a gain of 1/M (where M is an arbitrarily set value of greater than 1), a delay unit 254 which delays an output signal of the filter 250 by 1H period, an amplifier 256 having a gain set at (M-1)/M, and an adder 258.

A brightness reduction ratio $C(N,n_{ave})$ output at each 1H period from the brightness reduction ratio calculation unit 220 or 230 is supplied to the amplifier 252 which multiplies (attenuates) the brightness reduction ratio by 1/M and $C(N,n_{ave})/M$ is output to the adder 258.

A filter output $Clpf(N,n_{ave}-1)$ of 1H period before the current period which is delayed by the delay unit 256 is supplied to the amplifier 256 where the filter output is multiplied by (M-1)/M and $Clpf(N,n_{ave}-1)\times(M-1)/M$ is output to the adder 258.

The adder 258 adds $C(N,n_{ave})/M$ and $Clpf(N,n-1)\times(M-1)/M$ and the sum is output to the multiplier 320 as the brightness reduction ratio Clpf(N,n) to be applied to the nth horizontal scan line of the Nth frame.

In this manner, in the filter 250, by setting the summation ratio with the brightness reduction ratio of a 1H period prior to the current period to be higher than the calculated most-recent brightness reduction ratio, a rapid change of the brightness reduction ratio is prevented.

Second Alternative Embodiment

In the first through third preferred embodiments, there is a possibility that the panel current temporarily will exceed the limit current level when the scene is changed from a very bright scene into a slightly bright scene. In the second alternative embodiment, in order to more reliably prevent the panel current from exceeding the limit level, values of a difference of line data (as in the first preferred embodiment) and a ratio of line data (as in the second preferred embodiment) are determined and the difference or ratio is replaced with an arbitrary value depending on the determination result. The application of this configuration to the third preferred embodiment can be achieved by replacing the difference or ratio by an arbitrary value and using, as the frame data, data from the nth line of the (N−1)th frame to the (n−1)th line of the Nth frame.

More specifically, in the first preferred embodiment, when the value of i(N,n)−i(N−1,n) calculated in the comparative calculation unit 216 is negative (when brightness decreases), the comparative calculation unit 216 does not use the difference, but instead, outputs 0 [i(N,n)−(N−1,n)=0] to the frame data prediction unit 222.

Regarding the second preferred embodiment, when the value of i(N,n)/i(N−1,n) calculated in the comparative calculation unit 226 is less than 1, the comparative calculation unit 226 does not use the ratio, but instead, outputs 1 [i(N,n)/i(N−1,n)=1] as the ratio data to the frame data prediction unit 228.

By applying such a process, it is possible to prevent a situation in which the scene changes from a very bright scene to a slightly bright scene, the reduction in current is overestimated, a current value which is smaller than the actual current value is predicted, and brightness limitation cannot be sufficiently applied. In particular, in the third preferred embodiment in which the calculation is performed using the data from the nth line of the (N−1)th frame to the (n−1)th line of the Nth frame as the basic frame data, it is possible to more reliably limit the panel current to a value of less than or equal to the limit value.

By applying the process of the second alternative embodiment, when the scene changes from a bright scene into a dark scene, although the return of contrast is slower, the power consumption can be reduced and the lifetime of the OLED element can be prolonged.

Third Alternative Embodiment

In the above-described preferred embodiments and alternative embodiments, a 1H delay unit 310 is provided so that the line of the calculation target coincides with the line to be displayed. As described in the description of the first preferred embodiment, the 1H delay unit 310 may be omitted. When the 1H delay unit 310 is omitted, the response is delayed by one line. However, the influence is only one over the total number of all horizontal lines with respect to the total panel current. Therefore, omitting this block does not normally cause a problem.

When the 1H delay unit 310 is omitted, the brightness reduction ratio is calculated by the following equations:

When it is determined that:

$$I(N-1,1)+(i(N,n)-i(N-1,n))\times k>I_{lim} \quad \text{Equation 10}$$

C(N,n+1) is set as:

$$C(N,n+1)=I_{lim}/(I(N-1,1)+(i(N,n)-i(N-1,n)\times k) \quad \text{Equation 11}$$

In other words, in the third alternative embodiment, a brightness reduction process is applied to the pixel data of horizontal scan lines of later than the nth horizontal scan line of the Nth frame (more specifically, the (n+1)th horizontal scan line) based on the comparative calculation between the pixel data of the nth horizontal scan line of the Nth frame and the pixel data of the nth horizontal scan line of the (N−1)th frame.

Fourth Alternative Embodiment

In the above-described preferred embodiments and comparative examples, a total sum (sum) of pixel data for one horizontal scan line is calculated by the line data calculation unit 210 and the total sum is used for setting the brightness reduction ratio. The value to be used for setting the brightness reduction ratio is not limited to a total sum, and alternatively, an average value of the pixel data of one horizontal scan line may be used. The average value can be calculated by dividing the total sum of 1H of pixel data obtained by the line data calculation unit 210 by a number of pixels of a horizontal scan line (which equals to the number of columns 1 of the panel). In this case, the frame delay unit 212 delays the average value of the 1H data by one frame and the 1V data calculation units 214 and 224 may calculate an average value of pixel data corresponding to one frame instead of the total sum. Calculation processes in the comparative calculation unit 216, frame data prediction unit 222, and brightness reduction ratio calculation unit 222 may be identical to those in the preferred embodiments.

In the preferred embodiments and comparative example, a case is exemplified in which the limit level of the brightness and the limit level of panel current are set at 48%. The present invention is not limited to these limit values of 48%, and the limit value may be set at a suitable value in consideration of the required power consumption of the device and light emission characteristic of the display element. Alternatively, it is also possible to employ a configuration in which the limit level is variable depending on the situation.

PARTS LIST

1 element driving tft
2 selection tft
3 oled organic el element
100 display panel
210 line data calculation unit
212 frame delay unit
214 data summation unit
216 comparative calculation unit
220 brightness determination unit
222 frame data prediction unit
224 brightness reduction ratio calculation unit
226 comparative calculation unit
228 frame data prediction unit
230 brightness reduction ratio calculation unit
232 frame data prediction unit
234 brightness reduction ratio calculation unit
240 low pass filters
250 low pass filters
252 amplifier
254 delay unit
256 amplifier
258 adder
300 driving device driving circuit
310 horizontal scan period delay unit
320 multiplier
330 correction units
340 converter

The invention claimed is:

1. A driving device, for a display device, that displays a desired image on a display panel having a display element in which each of a plurality of pixels are arranged in a matrix form, comprising:

a comparative calculation unit that compares, among pixel data corresponding to display content of each pixel in the matrix, by using pixel data corresponding to an nth horizontal scan line in an Nth frame and pixel data corresponding to an nth horizontal scan line of an (N−1)th frame; and a brightness determination unit that sets a brightness reduction ratio, the brightness determination unit determining the brightness reduction ratio with respect to pixel data corresponding to the nth horizontal scan line of the Nth frame or a later horizontal scan line of the Nth frame as a function of the comparative calculation and a total value of all pixel data from the nth horizontal scan line of the (N−1)th frame to an (n−1)th horizontal scan line of the Nth frame; and means coupled to the brightness control unit for controlling power supplied to the display element.

2. A driving device for a display device according to claim 1, wherein:

the brightness determination unit determines a predicted value of all pixel data of the Nth frame based on the result of the comparative calculation and the total value of all pixel data corresponding to the the total value of all pixel data from the nth horizontal scan line of the (N−1) th frame to the (N−1)th horizontal scan line of the Nth frame, and when the predicted value exceeds a predetermined limit value, the brightness determination unit determines the brightness reduction ratio with respect to the pixel data corresponding to the nth horizontal scan line or a later horizontal scan line to the Nth frame in such a manner that the predicted value does not exceed the predetermined limit value.

3. A driving device for a display device according to claim 1 further comprising:

a line data calculation unit that calculates one line of pixel data corresponding to the nth horizontal scan line of the Nth frame; and a delay unit that delays the line data calculated by the line data calculation unit by one frame period, wherein the comparative calculation unit compares line data of pixel data corresponding to the nth horizontal scan line of the (N−1)th frame which is one frame before the current frame and is delayed by the delay unit and line data of the pixel data corresponding to the nth horizontal scan line of the Nth frame and supplies the result of the comparative calculation to the brightness determination unit.

4. A driving device for a display device according to claim 1, wherein:

the line data calculation unit determines a sum or an average of one line of pixel data corresponding to the nth horizontal scan line of the Nth frame.

5. A driving device for a display device according to claim 1, wherein:

the comparative calculation unit calculates, as the result of the comparative calculation, a difference between the pixel data corresponding to the nth horizontal scan line of the Nth frame and pixel data corresponding to the nth horizontal scan line of the (N−1)th frame.

6. A driving device for a display device according to claim 1, wherein:

the comparative calculation unit calculates, as the result of the comparative calculation, a ratio between pixel data corresponding to the nth horizontal scan line of the Nth frame and pixel data corresponding to the nth horizontal scan line of the (N−1)th frame.

7. A driving device for a display device according to claim 1, wherein:

when the difference between the pixel data corresponding to the nth horizontal scan line of the Nth frame and the pixel data of the nth horizontal scan line of the (N−1)th frame is negative or the ratio between the pixel data corresponding to the nth horizontal scan line of the Nth frame and the pixel data of the nth horizontal scan line of the (N−1)th frame is less than 1, the brightness reduction ratio is determined as if the difference is 0 or the ratio is 1.

8. A driving device for a display device according to claim 1, further comprising:

a low pass filter at an input side or an output side of a calculation unit of the brightness reduction ratio.

9. A driving method of a display device in which a desired image is displayed on a display panel having a display dement in each of a plurality of pixels arranged in a matrix form, the method comprising:

comparing, among pixel data corresponding to a display content in each pixel, pixel data corresponding to an nth horizontal scan line of an Nth frame and pixel data corresponding to an nth horizontal scan line of an (N−1) th frame; and setting a brightness reduction ratio with respect to pixel data corresponding to the nth horizontal scan line of the Nth frame or a later horizontal scan line of the Nth frame based as a function of the comparison and all pixel data corresponding to all pixel data from the nth horizontal scan line of the (N−1)th frame to an (n−1)th horizontal scan line of the Nth frame; and controlling power supplied in response to the brightness reduction ratio to the display element.

10. A driving device or a driving method for a display device according to claim 9, wherein:

the display element is a current-driven element which emits light at a brightness corresponding to an amount of supplied current; and a current corresponding to the set brightness reduction ratio is supplied to each display element.

* * * * *